US012484753B2

(12) United States Patent
Fang et al.

(10) Patent No.: US 12,484,753 B2
(45) Date of Patent: Dec. 2, 2025

(54) LIFTABLE AND ROTATABLE MOP STRUCTURE AND CLEANING MACHINE

(71) Applicant: NINGBO FUJIA INDUSTRIAL CO., LTD., Zhejiang (CN)

(72) Inventors: Jianqiang Fang, Zhejiang (CN); Xu Wang, Zhejiang (CN)

(73) Assignee: NINGBO FUJIA INDUSTRIAL CO., LTD., Ningbo (CN)

( * ) Notice: Subject to any disclaimer, the term of this patent is extended or adjusted under 35 U.S.C. 154(b) by 433 days.

(21) Appl. No.: 18/089,595

(22) Filed: Dec. 28, 2022

(65) Prior Publication Data

US 2023/0142075 A1 May 11, 2023

Related U.S. Application Data

(63) Continuation of application No. PCT/CN2021/102889, filed on Jun. 29, 2021.

(30) Foreign Application Priority Data

Jun. 29, 2020 (CN) ..... 202021226406.9

(51) Int. Cl.
*A47L 11/40* (2006.01)
*A47L 11/282* (2006.01)

(52) U.S. Cl.
CPC ..... *A47L 11/4058* (2013.01); *A47L 11/282* (2013.01); *A47L 11/4038* (2013.01); *A47L 11/4052* (2013.01); *A47L 11/4055* (2013.01); *A47L 11/4069* (2013.01)

(58) Field of Classification Search
CPC ..... A47L 11/00; A47L 11/40; A47L 11/4052; A47L 11/4055; A47L 11/4058; A47L 11/4038; A47L 11/4069; A47L 11/282; A47L 11/283; A47L 11/16; A47L 11/164; A47L 11/24
See application file for complete search history.

(56) References Cited

FOREIGN PATENT DOCUMENTS

| | | | | |
|---|---|---|---|---|
| CN | 103006153 A | | 4/2013 | |
| CN | 108125632 A | | 6/2018 | |
| CN | 109157165 A | * | 1/2019 | ..... A47L 11/24 |
| CN | 208926225 U | | 6/2019 | |
| CN | 106965151 B | * | 7/2019 | ..... A47L 11/24 |
| CN | 109953701 A | | 7/2019 | |

(Continued)

OTHER PUBLICATIONS

Office Action dated Aug. 9, 2024 for Corresponding European Application No. 21833107.2.

(Continued)

*Primary Examiner* — C. A. Rivera

(57) ABSTRACT

A liftable and rotatable mop structure and a cleaning machine are provided. The liftable and rotatable mop structure includes a mop unit which includes a mop, a turntable and a rotatable shaft, wherein the mop is connected with the turntable, and the rotatable shaft is connected with the turntable; the rotatable shaft functions to lift the turntable and drive the turntable to rotate, and includes an inner shaft and an outer shaft surrounding the inner shaft; a limiting structure is arranged between the inner shaft and the outer shaft so that the inner shaft and the outer shaft are movable relative to each other in an axial direction but are limited in a circumferential direction.

11 Claims, 3 Drawing Sheets

(56) References Cited

FOREIGN PATENT DOCUMENTS

| | | | |
|---|---|---|---|
| CN | 209808233 | U | 12/2019 |
| CN | 110897566 | A | 3/2020 |

OTHER PUBLICATIONS

International Search Report dated Sep. 30, 2021 for corresponding PCT Application No. PCT/CN2021/102889.
Written Opinion of the International Search Authority in corresponding International application No. PCT/CN2021/102889.
Office Action dated Nov. 14, 2023 for corresponding Japan Application No. 2022-681015 along its English Translation.

* cited by examiner

LIFTABLE AND ROTATABLE MOP STRUCTURE AND CLEANING MACHINE

CROSS REFERENCE

The present application is a Continuation Application of PCT Application No. PCT/CN2021/102889, filed on Jun. 29, 2021, which claims the priority of Chinese Patent Application No. 202021226406.9, filed on Jun. 29, 2020, the entire contents of which are hereby incorporated by reference.

TECHNICAL FIELD

The present invention relates to the technical field of cleaning equipment, in particular to a liftable and rotatable mop structure and a cleaning machine.

DESCRIPTION OF THE PRIOR ART

Cleaning machines have important market value due to the functions thereof such as automatically rotating to clean the floor. However, in the existing cleaning machines, the rotatable mop units are usually lifted and lowered integrally. In other words, the frame or the housing in which the mop units are mounted is lifted and lowered as a whole. The driving mechanisms are required to be mounted in the frame or the housing for driving the mop units to rotate to clean. That is, the mop units are lifted indirectly. This results in a heavy machine. The applicant has found that the technical features of the integral lifting lead to an easy change of the center of gravity, which has an adverse effect on the stable operation of the cleaning machine. Therefore, in the process of design, production and manufacturing, it is necessary to pay special attention to the matching of the center of gravity under different conditions. The existing cleaning machines are not only complicated in structure, but also complicated in design, production and manufacturing, and relatively high in cost.

SUMMARY OF THE DISCLOSURE

In view of the above problems existing in the prior art, the present invention provides a liftable and rotatable mop structure, the mop of which can be directly and separately, solving the problem that the weight of the lifted portion is heavy. A cleaning machine is further provided which uses the aforementioned liftable and rotatable mop structure.

The specific technical scheme is as follows:

A liftable and rotatable mop structure includes a mop unit which includes a mop, a turntable and a rotatable shaft. The mop is connected with the turntable, and the rotatable shaft is connected with the turntable. The rotatable shaft functions to lift the turntable and drive the turntable to rotate, and includes an inner shaft and an outer shaft surrounding the inner shaft. A limiting structure is arranged between the inner shaft and the outer shaft so that the inner shaft and the outer shaft are movable relative to each other in an axial direction but are limited in a circumferential direction. The outer shaft is configured to rotate to drive the inner shaft to rotate synchronously through the limiting structure, and the inner shaft is connected with the turntable and functions to drive the turntable to lift and rotate synchronously. Alternatively, the inner shaft is configured to rotate to drive the outer shaft to rotate synchronously through the limiting structure, and the outer shaft is connected with the turntable and functions to drive the turntable to lift and rotate synchronously.

The advantageous effects of the above technical solution are:

In the design of the present invention, the rotatable shaft is used for lifting the turntable and driving the turntable to rotate, so that the weight of the lifted portion of the mop unit is greatly reduced and the gravity center of the whole device can be conveniently determined, avoiding a heavy lifted portion. In addition, in the case of multiple mops, the technical solution of the present application facilitates the independent lifting of each mop.

Preferably, when the inner shaft is connected with the turntable, the limiting structure is provided with a connecting portion for connecting with a lifting mechanism which is configured to drive the inner shaft to move axially relative to the outer shaft through the connecting portion.

Preferably, the outer shaft has a fixed axial position, and the outer shaft is connected with a bearing for rotatably supporting the outer shaft.

Preferably, the connecting portion is configured as a crossbar arranged on a periphery of the inner shaft, and the crossbar passes through a groove defined in the outer shaft and is movable upward and downward along the groove; and a lifting member of the lifting mechanism is configured to drive the inner shaft to move upward relative to the outer shaft through the crossbar, and when the lifting member descends, the inner shaft moves downward relative to the outer shaft.

Preferably, the crossbar also serves as a circumferential transmission component, and when the outer shaft rotates, the crossbar is driven to rotate through the groove, the crossbar rotates to drive the inner shaft to rotate, the inner shaft rotates to drive the turntable to rotate, which in turn drives the mop to rotate.

Preferably, the liftable and rotatable mop structure further includes a spring member for resiliently supporting the inner shaft and/or the turntable downward in the case where the inner shaft is connected with the turntable, or for resiliently supporting the outer shaft and/or the turntable downward in the case where the outer shaft is connected with the turntable.

Preferably, the spring member is a compression spring, and the compression spring is disposed between the inner shaft and an upper end of the outer shaft.

Preferably, the compression spring is set in a compressed state when the mop abuts a surface to be cleaned.

Preferably, the liftable and rotatable mop structure further includes a position detection mechanism for controlling the lifting position of the mop.

The present invention further provides a cleaning machine, which is provided with the aforementioned liftable and rotatable mop structure.

The advantageous effects of the above technical solution are:

In the present invention, the mop is directly lifted and lowered, so that the problem of heavy weight of the lifted portion is overcome, and the lifting function of the mop is relatively reliable in the long-term use process of the cleaning machine, so the reliability of the clean machine is greatly improved.

Figure 1:
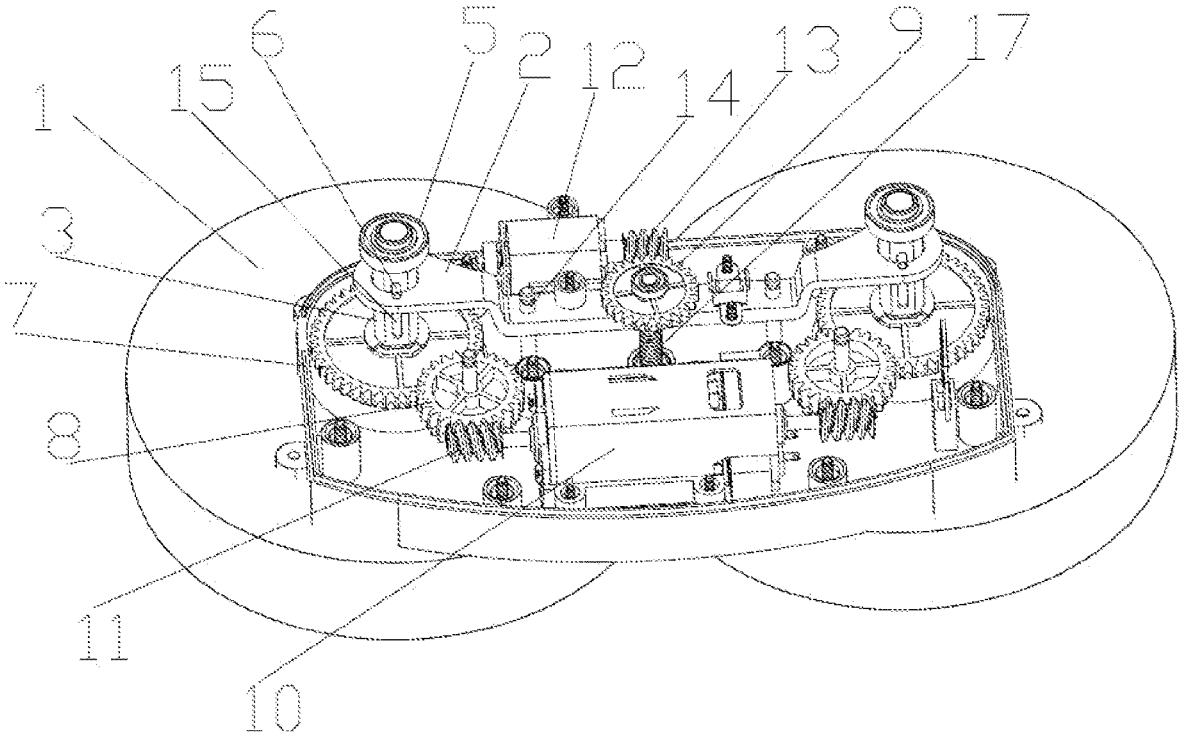
FIG. 1 is a perspective view of a mop unit lifting device using the liftable and rotatable mop structure of the present invention.
Figure 2:
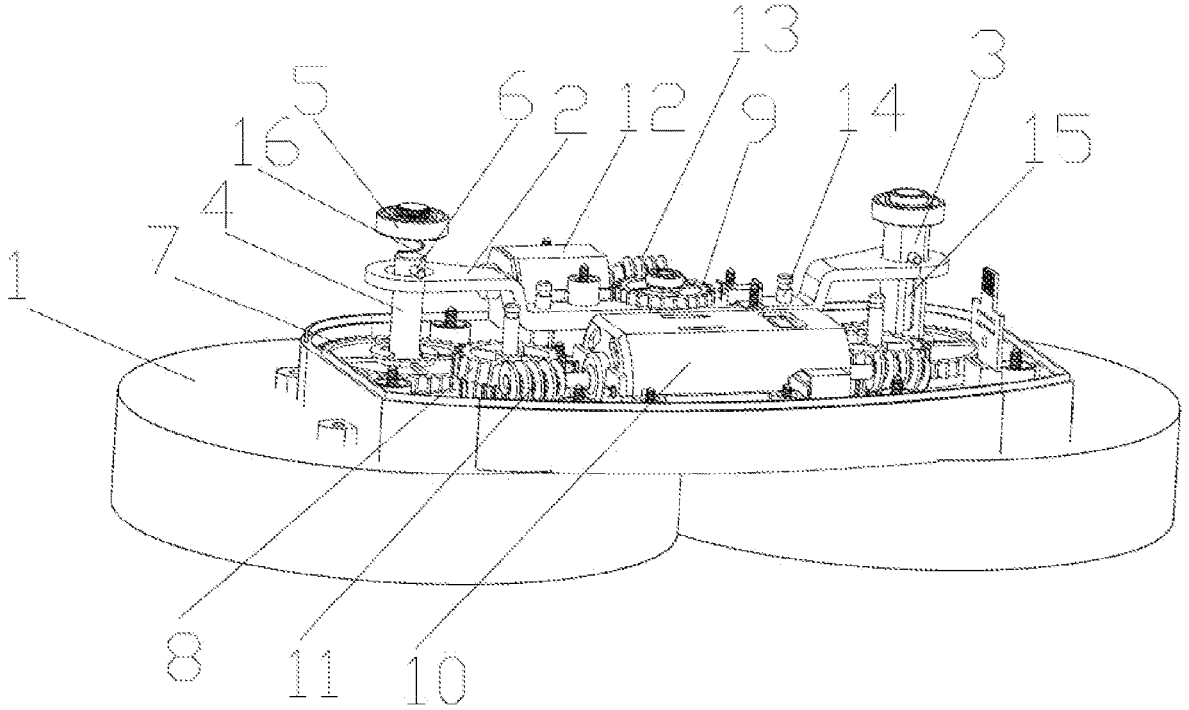
FIG. 2 is another perspective view of the mop unit lifting device using the liftable and rotatable mop structure of the present invention, with the outer shaft omitted.
Figure 3:
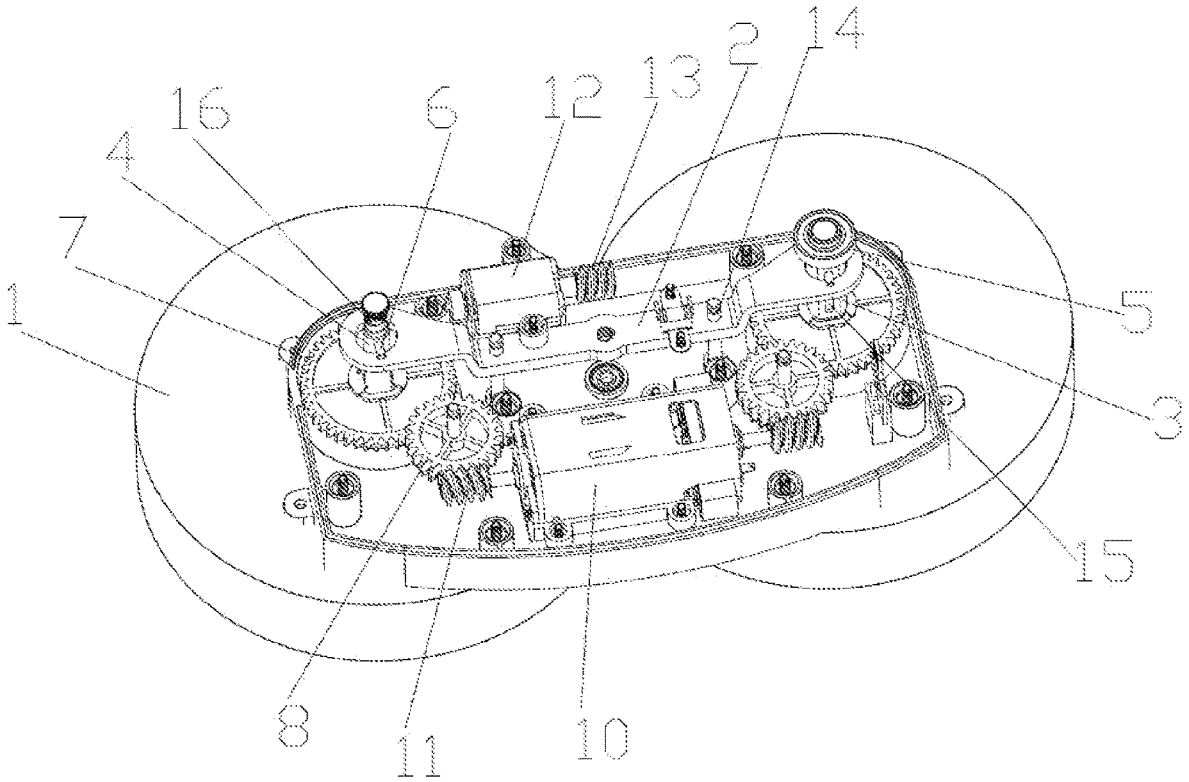
FIG. 3 is a further perspective view of the mop unit lifting device using the liftable and rotatable mop structure of the present invention, with the screw omitted.

List of the reference numerals: 1, mop unit, 2, lifting member, 3, outer shaft, 4, inner shaft, 5, bearing, 6, connecting portion, 7, gear, 8, first worm gear, 9, second worm gear, 10, first motor, 11, first worm, 12, second motor, 13, second worm, 14, guide rod, 15, groove, 16, spring member, 17, screw.

DESCRIPTION OF EMBODIMENTS

The following description is a disclosure of the invention intended to enable those skilled in the art to implement the invention. The preferred embodiments in the following description are merely for example. Those skilled in the art can conceive other obvious alternatives accordingly. The basic principles of the invention described in the following description can be applied to other embodiments, modifications, improvements, alternatives, and others without departing from the spirit and scope of the invention.

It will be understood by those skilled in the art that in the present disclosure, the terms such as "longitudinal", "transversal", "upper", "lower", "front", "rear", "left", "right", "vertical", "horizontal", "top", "bottom", "inner", and "outer" refer to orientations or positional relationships shown in the drawings, which are merely for convenience of description and simplification of description, rather than indicating or implying that the means or elements referred to must have a particular orientation, or be constructed and operated in a particular orientation. Therefore, the above terms are not to be construed as limiting the invention.

As shown in FIG. 1, a mop unit lifting device using the liftable and rotatable mop structure of the present invention, in this embodiment, includes two rotatable mop units 1 for cleaning arranged in a substantially left-and-right symmetrical distribution, a lifting mechanism for lifting the mop unit 1, and a driving mechanism for driving the mop unit 1 to rotate.

In this embodiment, the lifting mechanism is provided separately from the mop unit 1.

The lifting mechanism can use a rack-and-pinion lifting mechanism or a screw lifting mechanism or a cam lifting mechanism or a swing link lifting mechanism or an electromagnetic lifting mechanism. The swing link lifting mechanism can be, for example, a shift fork lifting mechanism which shifts the fork to realize lifting. The electromagnetic lifting mechanism can be, for example, an electromagnetic valve lifting mechanism which realizes lifting by moving the valve core of the electromagnetic valve, or an electromagnet lifting mechanism which realizes lifting by attracting the electromagnet. For example, an iron piece can be arranged at the upper end of the mop unit 1, and an electromagnet can be arranged above the iron piece. When the electromagnet is energized, the electromagnet attracts the iron piece, thereby lifting the mop unit 1. When the electromagnet is de-energized, the attraction force disappears, and the mop unit 1 is lowered. In this embodiment, the screw lifting mechanism is used.

The above structure can be applied to this application, and can be flexibly selected according to the requirements of the center of gravity of the whole device.

The screw lifting mechanism is provided separately from the mop unit 1. The screw lifting mechanism is provided with a lifting member 2. The lifting member 2 is connected with the mop unit 1. The screw lifting mechanism indirectly drives the mop unit 1 to lift through the lifting member 2. This structure allows the lifting mechanism to be provided separately from the mop unit 1.

The lifting member 2 is configured as a beam, which is connected to each mop unit 1. A driving part of the lifting mechanism is arranged between the mop units 1, and the driving part is used for driving the beam to lift. This structure is compact, simple and reliable. In addition, the mop units 1 have good synchronization in lifting and lowering. Further, it is convenient to arrange the components of the lifting mechanism, and it is also convenient to arrange the driving part in the middle position of the beam. The mechanical properties of the lift are better if the driving part is arranged in the middle of the beam.

In this embodiment, two mop units 1 are provided, and the beam can be provided as a striped beam. Two ends of the beam are respectively connected with one mop unit 1. A screw 17 is arranged between the two mop units 1. The screw 17 is screwed to the beam, and the screw 17 rotates to drive the beam to lift. The screw 17 is located in the middle of the beam. In this embodiment, the portion between the two ends of the beam is concaved for height control.

The mop unit 1 includes a mop, a turntable and a rotatable shaft. The mop is connected with the turntable, the rotatable shaft is connected with the turntable, and the rotatable shaft is used for lifting the turntable and driving the turntable to rotate.

The turntable can be the lower portion of the rotatable shaft, or it can be a separate turntable for installing the mop.

The rotatable shaft includes an inner shaft 4 and an outer shaft 3 surrounding the former. A limiting structure is arranged between the inner shaft 4 and the outer shaft 3 which allows the axial movements of the inner shaft 4 and the outer shaft 3 relative to each other but limits the circumferential movements of the inner shaft 4 and the outer shaft 3 relative to each other. The outer shaft 3 rotates to drive the inner shaft 4 to rotate synchronously through the limiting structure. The inner shaft 4 is connected with the turntable for driving the turntable to lift and rotate synchronously. Alternatively, the inner shaft 4 rotates to drive the outer shaft 3 to rotate synchronously through the limiting structure. The outer shaft 3 is connected with the turntable, and the outer shaft 3 is used to lift and rotate the turntable synchronously. This structure is simple, compact, stable and reliable.

In this embodiment, the outer shaft 3 is connected with a first driving mechanism in a transmission manner. The outer shaft 3 rotates to drive the inner shaft 4 to rotate synchronously through the limiting structure. The limiting structure is provided with a connecting portion 6 connected with the lifting mechanism. The lifting mechanism is provided separately from the mop unit 1, and drives the inner shaft 4 to move axially relative to the outer shaft 3 via the connecting portion 6. This structure can greatly simplify the arrangement and distribution of the first driving mechanism and the lifting mechanism, reducing the weight of the lifted portion of the mop unit 1, and further optimize the center of gravity of the whole device.

The screw lifting mechanism employed in this embodiment includes a second motor 12, a second worm 13 connected to the second motor 12, a second worm gear 9 connected to the second worm 13, and a screw 17 connected to the second worm gear 9. The screw 17 is screwed with the lifting member 2. The second motor 12 rotates to drive the screw 17 to rotate through the worm and worm gear transmission, and the screw 17 rotates to lift the lifting member 2.

Two ends of the lifting member 2 respectively surround the outer shafts 3 and can move up and down relative to the outer shafts 3. In this embodiment, the connecting portion 6 is configured as a crossbar arranged on the periphery of the inner shaft 4. The crossbar passes through the groove 15 defined in the outer shaft 3 and can move upward and downward along the groove 15. In order to obtain more uniform force, two crossbars are evenly distributed on the periphery. The lifting member 2 drives the inner shaft 4 upward through the crossbar, and the inner shaft 4 moves upward relative to the outer shaft 3. In turn, when the lifting member 2 descends, the inner shaft 4 is moved downward relative to the outer shaft 3.

The crossbar also serves as a circumferential driving component. That is, when the outer shaft 3 rotates, the crossbar is driven to rotate through the groove 15, thereby driving the inner shaft 4 to rotate, and the inner shaft 4 rotates to drive the turntable to rotate, thereby driving the mop to rotate.

In this embodiment, the first driving mechanism includes a first motor 10, first worms 11, and first worm wheels 8. The first motor 10 is a dual-output motor, and two rotating ends of the dual-output motor are respectively connected with one first worm 11. Accordingly, two first worm wheels 8 are used. The first motor 10 drives the shafts for the respective first worm gears 8 to rotate, and the shafts for the respective first worm gears 8 drive the respective gears 7 connected to the outer shafts 3 to rotate through gear transmission, thereby driving the respective outer shafts 3 for the two mop units 1 to rotate by a single first motor 10.

Further, a spring member 16 is provided. In the case where the inner shaft 4 is connected with the turntable, the spring member 16 is used to resiliently support the inner shaft 4 or/and the turntable downwardly. In the case where the outer shaft 3 is connected with the turntable, the spring member 16 is used to resiliently support the outer shaft 3 and/or the turntable downwardly. In this embodiment, it is the inner shaft 4 that is connected to the turntable. In this configuration, since the spring member 16 provides a downward resilient support, the lifting mechanism needs only to lift the mop unit 1. When the spring member 16 needs to be lowered, the lifting mechanism releases the mop unit 1, which descends spontaneously under the action of the gravity of the mop unit 1. Under the action of the spring member 16, the mop resiliently attaches to the surface to be mopped. The mop also ascends and descends under the action of the spring member, allowing the mop to better clean the surface to be mopped. The design of the spring member 16 greatly improves the compactness of the device.

The spring member 16 is a compression spring, which is disposed between the inner shaft 4 and the upper end of the outer shaft 3, with a very compact structure. The outer shaft 3 is provided with bearings 5 at the upper and lower ends thereof and is disposed between the two bearings 5.

When the lifting member 2 ascends, the inner shaft 4 ascends and the compression spring is compressed. When the lifting member 2 descends, the compression spring resiliently supports the inner shaft 4 downward. In this embodiment, in order to allow the mop to attach the surface to be cleaned better, the compression spring is set to be in the compressed state when the mop attaches the surface to be cleaned, so that a self-adaptive cleaning on the uneven surface to be cleaned can be realized, and the cleaning effect is better as a certain pressure is applied to the mop when cleaning.

A position detection mechanism is further provided for controlling the lifting position of the mop unit 1. For example, a code disc for position detection is provided to the second motor 12, and the position of rotation of the second motor 12 is detected by the code disc, thereby controlling the lifting position of the mop unit 1. Such a design can avoid the lifting abnormality caused by power failure, program operation error, etc. When an accident occurs, as long as the code disc is detected to return to zero, the control portion can know that the mop unit 1 has returned to the initial position, so that the second motor 12 can be stopped in time, avoiding a continuing rotation of the motor having reached the position. The reliability of the lifting function is thus significantly improved.

In this embodiment, the overall distribution of the mop unit lifting device is as follows: two mop units 1 are arranged left and right, respectively, the lifting member 2 is located between two axes of the two mop units 1, the first driving mechanism is located at the front side of the lifting member 2, the first motor 10 is centrally disposed, the screw lifting mechanism is located at the rear side of the lifting member 2, and the screw 17 is centrally disposed. A guide rod 14 is further provided for stably lifting the lifting member 2. This distribution is compact, with a low profile, and space saving. In terms of the performance, the lifting function can be well realized, and the lifting motion is stable and accurate, with stable and reliable performance.

A cleaning machine is provided with the mop unit lifting device, that is, the mop unit lifting device is installed in a cabinet of the cleaning machine, and the motor and the code disc are connected with the control portion of the cleaning machine for control.

The operation principle of the present invention may be referred to as follows: when it is necessary to lift the mop unit 1, the first motor 10 remains stopped, the second motor 12 rotates to lift the lifting member 2, the lifting member 2 lifts the inner shaft 4, thereby lifting the mop unit 1. In case of lowering the mop unit 1, when the mop unit 1 is lowered into position, the first motor 10 is restarted, so that cleaning can continue.

In the present invention, the mop unit 1 is directly lifted and lowered, the problem that the lifted portion is heavy can be solved. In addition, the embodiment of the invention has the advantage of simple and compact structure, good durability, stability, reliability and low cost, and has strong practicability, promoting the upgrading of the lift of the mop unit, making the cleaning machine more user friendly.

The above description is only illustration of the invention, but is not to be construed as limiting the claims. The present invention is not limited to the above embodiments, and the specific structure thereof can be modified. Various modifications made within the scope of the independent claims of the present invention are within the scope of the present invention.

The invention claimed is:

1. A liftable and rotatable mop structure, comprising a mop unit which comprises a mop, a turntable and a rotatable shaft, wherein the mop is connected with the turntable, and the rotatable shaft is connected with the turntable; the rotatable shaft functions to lift the turntable and drive the turntable to rotate, and comprises an inner shaft and an outer shaft surrounding the inner shaft; a limiting structure is arranged between the inner shaft and the outer shaft so that the inner shaft and the outer shaft are movable relative to each other in an axial direction but are limited in a circumferential direction; the outer shaft is configured to rotate to drive the inner shaft to rotate synchronously through the limiting structure, and the inner shaft is connected with the turntable and functions to drive the turntable to lift and rotate synchronously; and wherein the limiting structure is provided with a connecting portion for connecting with a lifting mechanism which is configured to drive the inner shaft to move axially relative to the outer shaft through the connecting portion.

2. The liftable and rotatable mop structure of claim 1, wherein the outer shaft has a fixed axial position, and the outer shaft is connected with a bearing for rotatably supporting the outer shaft.

3. The liftable and rotatable mop structure of claim 1, wherein the connecting portion is configured as a crossbar arranged on a periphery of the inner shaft, and the crossbar passes through a groove defined in the outer shaft and is movable upward and downward along the groove; and a lifting member of the lifting mechanism is configured to drive the inner shaft to move upward relative to the outer shaft through the crossbar, and when the lifting member descends, the inner shaft moves downward relative to the outer shaft.

4. The liftable and rotatable mop structure of claim 2, wherein the connecting portion is configured as a crossbar arranged on a periphery of the inner shaft, and the crossbar passes through a groove defined in the outer shaft and is movable upward and downward along the groove; and a lifting member of the lifting mechanism is configured to drive the inner shaft to move upward relative to the outer shaft through the crossbar, and when the lifting member descends, the inner shaft moves downward relative to the outer shaft.

5. The liftable and rotatable mop structure of claim 3, wherein the crossbar also serves as a circumferential transmission component, and when the outer shaft rotates, the crossbar is driven to rotate through the groove, the crossbar rotates to drive the inner shaft to rotate, the inner shaft rotates to drive the turntable to rotate, which in turn drives the mop to rotate.

6. The liftable and rotatable mop structure of claim 4, wherein the crossbar also serves as a circumferential transmission component, and when the outer shaft rotates, the crossbar is driven to rotate through the groove, the crossbar rotates to drive the inner shaft to rotate, the inner shaft rotates to drive the turntable to rotate, which in turn drives the mop to rotate.

7. The liftable and rotatable mop structure of claim 1, further comprising a spring member for resiliently supporting the inner shaft and/or the turntable downward.

8. The liftable and rotatable mop structure of claim 7, wherein the spring member is a compression spring, and the compression spring is disposed between the inner shaft and an upper end of the outer shaft.

9. The liftable and rotatable mop structure of claim 8, wherein the compression spring is set in a compressed state when the mop abuts a surface to be cleaned.

10. The liftable and rotatable mop structure of claim 1, further comprising a position detection mechanism for controlling the lifting position of the mop.

11. A cleaning machine, which is provided with the liftable and rotatable mop structure of claim 1.

* * * * *